United States Patent [19]

Norton

[11] 4,090,636

[45] May 23, 1978

[54] METAL PAINT PAIL COVER

[75] Inventor: Bernard W. Norton, Moraga, Calif.

[73] Assignee: B.W. Norton Manufacturing Co. Inc., Oakland, Calif.

[21] Appl. No.: 826,559

[22] Filed: Aug. 22, 1977

[51] Int. Cl.[2] ..... B65D 39/00

[52] U.S. Cl. ..... 220/307

[58] Field of Search ..... 220/306, 307, 308, 354; 150/.5; 215/355

[56] References Cited

U.S. PATENT DOCUMENTS

| | | | |
|---|---|---|---|
| 606,838 | 11/1977 | Heins | 220/354 |
| 4,004,710 | 1/1977 | Crisci | 220/306 |
| 4,027,776 | 6/1977 | Douglas | 220/307 |

*Primary Examiner*—George T. Hall

*Attorney, Agent, or Firm*—Owen, Wickersham & Erickson

[57] ABSTRACT

A pail-like container preferably made of plastic material is especially adapted to utilize a particular snap type cover of resilient metal material. The cover is shaped to form a peripheral channel with a bulbous, annular lower portion that is retained within an annular recess formed by two spaced apart annular ridge portions on the inner wall of the container near its open end. The first annular ridge portion provides a cam surface that helps to deform the bulbous lower portion of the cover temporarily and also slightly stretch the upper portion of the container circumferentially as the cover is installed on a container. The second annular ridge portion serves as a stop to limit the amount of insertion of the cover within the container and thereby provide a space underneath an outer strengthening bead on the cover to facilitate its removal.

9 Claims, 6 Drawing Figures

METAL PAINT PAIL COVER

This invention relates to containers and closures therefor and more particularly to plastic containers adapted to hold fluids such as paints and to be sealed by a cooperating snap-type metal closure.

BACKGROUND OF THE INVENTION

The traditional one gallon paint container, long used by the industry, was cylindrically shaped and made of metal. Its cover, also made of metal, utilized a peripheral locking bead element that formed an interference fit with an annular groove or channel at the upper end of the can or container.

One difficulty with the aforesaid so-called traditional paint can, was the inherent difficulty in removing the cover and also in replacing it on the container. Often the container channel would become filled with paint and thereby prevent the proper sealing of the cover as well as create clean-up problems. Without adequate sealing of its cover, paint in the old prior art containers tended to become dry and unuseable over a period of time.

Yet another problem arose with the metal paint cans of the prior art when used with latex paints. Because of their water content, such paints tended to cause corrosion within metal containers, particularly along fabrication joints or seams. This factor limited the storage time available for water based paints which tended to limit their marketability in metal containers.

Because of the aforesaid problems, the use of a suitable non-corrosive plastic material in containers for such products as paint became highly desirable. However, serious difficulties arose in providing a plastic container with sufficient strength and economy of manufacture and yet one with a closure capable of providing a durable, reliable seal that can be easily removed and replaced. U.S. Pat. No. 4,004,710 is typical of one prior art attempt to provide a paint container made of plastic material and using a plastic closure.

SUMMARY OF THE INVENTION

In the present invention, the aforesaid problems and disadvantages of prior art paint containers and their closures are overcome by an improved plastic container in combination with a uniquely cooperating metal cover. Both container and closure are easily manufactured at high production rates and relatively low unit cost. When assembled, they provide a container-closure combination for liquids with a highly effective seal that is durable and reliable even with rough handling. Yet, the cover can quickly and easily be removed and replaced by an average person without special tools or excessive effort. The plastic container is generally tapered for proper nesting with other empty containers, and it has a peripheral inverted channel portion around its open end for added strength. On the inside surface of the container wall near its open end are a pair of inwardly projecting and spaced apart annular ridge members that form an annular recess between them. These ridge members are shaped so that they can be readily formed on the container in production by conventional injection molding techniques. Yet, they both cooperate with and provide valuable functions in conjunction with the cover. The cover, which is preferably fabricated from sheet metal, has an outer, peripheral channel portion with an enlarged or bulbous lower portion and spaced apart inner and outer flanges. As the cover is applied to its container, the first ridge member contacts the bulbous portion of the cover causing the upper portion of the container to stretch a small amount circumferentially, thereby allowing the bulbous cover portion to "snap" into and seat itself within the annular recess below the first ridge member. The second ridge member stops the inward travel of the cover so that an outer peripheral bead on the cover is spaced above the inverted channel portion of the container. The space thus provided under the peripheral bead of the cover allows a simple tool such as a screwdriver to be inserted for removing the cover. When the cover is in place on the container, the upper and lower ridge portions on the container engage the outer surface of the peripheral bulbous portion and form two effective sealing areas that prevent any fluid flow into or out of the container. The sealing contacts are maintained even during rough handling by virtue of the geometry of the cooperating elements and their inherent resiliency.

Other objects, advantages and features of the invention will become apparent from the following detailed description of one preferred embodiment thereof, presented with the accompanying drawings.

DETAILED DESCRIPTION OF PREFERRED EMBODIMENT

Figure 1:
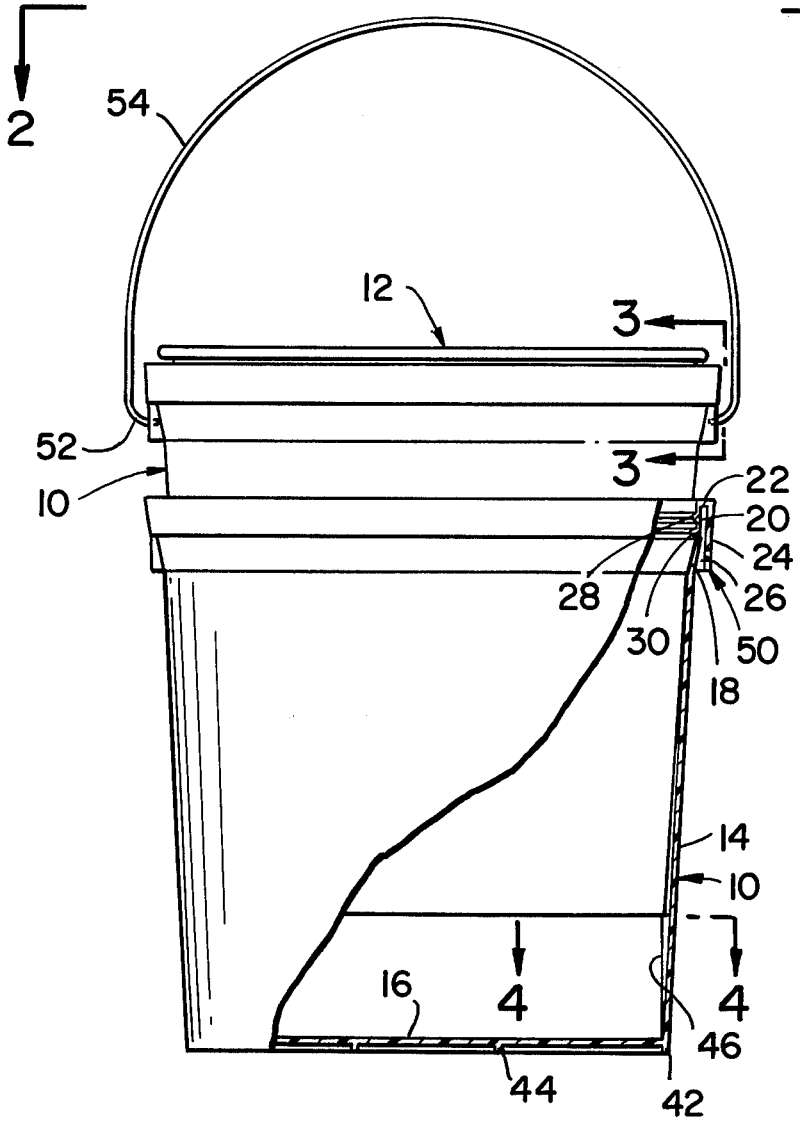
FIG. 1 is a view in elevation of a paint container with its assembled cover according to the present invention and with the container nested in another container having portions broken away.
Figure 3:
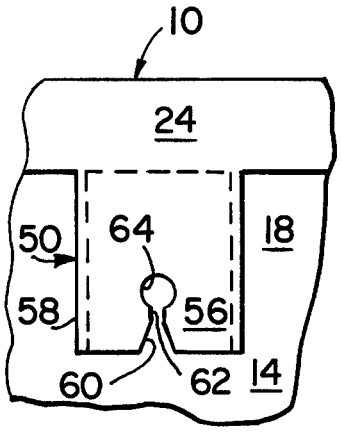
FIG. 3 is an enlarged fragmentary view in section taken along line 3—3 of FIG. 1 and showing a bail anchoring projection.
Figure 2:
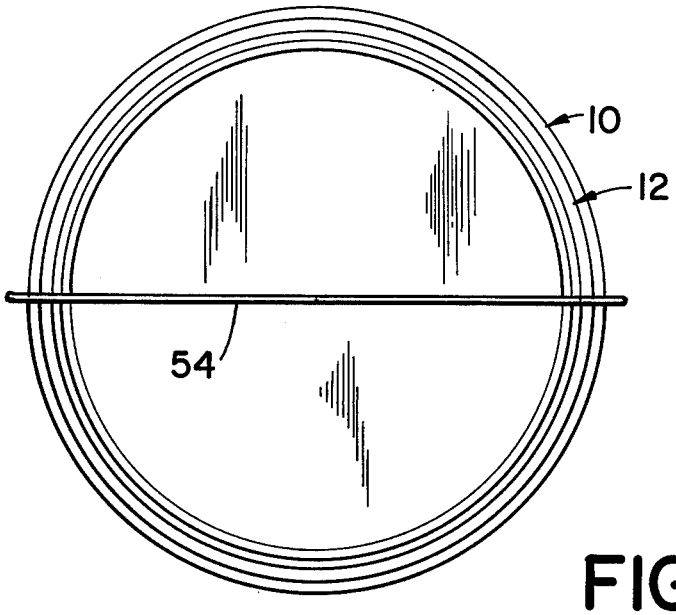
FIG. 2 is a top view of the container and cover of FIG. 1.

With reference to the drawing, FIG. 1 shows two containers 10 according to the present invention, which are nested together to illustrate their space saving capability when not filled. The containers are particularly adapted to contain liquid products such as paint and they are used in combination with a metal, snap-in, fluid tight cover 12 which will be described in detail below.

The containers are configured so as to be readily manufactured in high volume production from a suitable plastic material by injection molding techniques. A preferable plastic material is high density polyethylene, which has been used successfully for other containers because it provides adequate strength, durability and resistance to chemical damage from most substances. The container 10 is generally cylindrical with an annular and slightly conical side wall 14 that gradually increases in diameter as it extends upwardly from a bottom wall 16. Preferably the sidewall makes an angle of about 3° with the central container axis of symmetry so that it will nest properly with other like containers, as indicated in FIG. 1.

Near the upper end of the sidewall 14 is a relatively short conical section 18 having a somewhat large angle with the container axis of symmetry of about 13°. Extending above this short conical section is a short integral wall portion 20 forming the open end of the container 10 that is generally cylindrical and has no taper. Along its upper edge, this cylindrical wall portion 20 is integral with an outwardly extending end flange 22 that is itself integral with a downwardly extending outer flange 24. Thus, the wall portion 20 and the connected flanges 22 and 24 form an inverted U-shaped channel 26 that extends around the periphery of the container. This channel provides strength and rigidity to the open end of the container and its end flange 22 which is essentially in a plane perpendicular to the container axis and affords a firm base for supporting a tool used for removing the cover 12.

Figure 4:
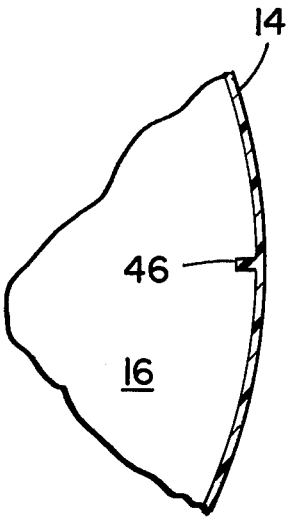
FIG. 4 is an enlarged fragmentary view in section taken at line 4—4 of FIG. 1.

On the inside surface of the cylindrical wall portion 20, and just inside the open end of the container (as best shown in FIG. 4) are a pair of spaced apart annular beads 28 and 30. These beads are integral with the wall portion 20 and between them is formed an annular recess 32.

Figure 5:
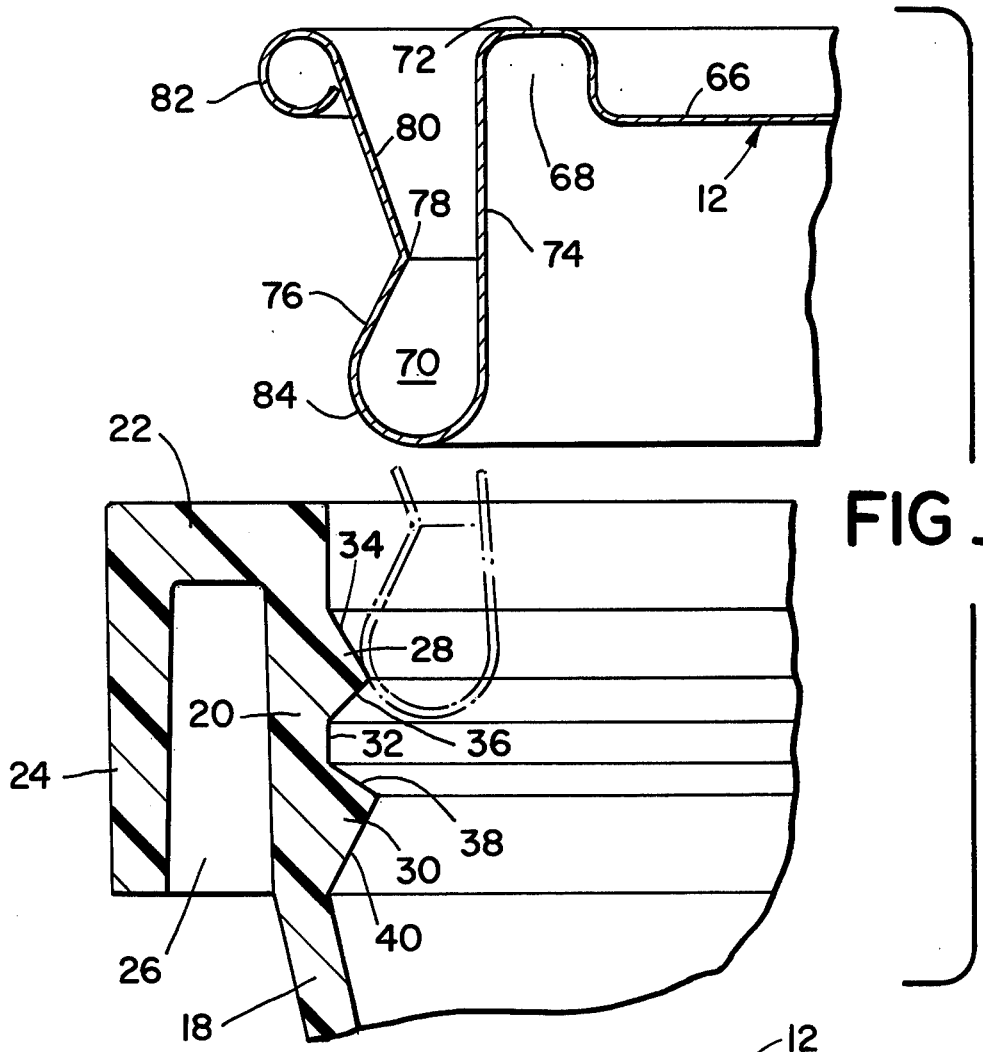
FIG. 5 is an exploded view in elevation and on a larger scale showing portions of the container and cover of FIG. 1 before being assembled and also with the cover shown in phantom in the process of being installed on the container.

As shown in FIG. 5, the uppermost bead 28 is generally triangular in cross section. It has an upper conical surface 34 that slopes toward and forms an angle of about 30° with the inner cylindrical surface of the wall portion 20. Thus, it functions to deflect the cover upon its initial entry and to cam it towards its installed position. An under surface 36 on the bead 28 slopes toward the wall portion 20 in the opposite direction at an angle of about 45°.

The lower bead 30 is spaced downwardly from the bead 28 and is shaped somewhat differently, having an upper conical surface 38 and a lower surface 40. The upper surface slopes upwardly and engages the cylindrical wall portion 20 at an angle of around 60° while the lower conical surface 40 is sloped in the opposite direction and engages the cylindrical side wall at around 30°. Both of the beads 28 and 30 cooperate to (1) guide the cover 12 into its seated position; (2) stretch or deflect the upper portion of the container so that the cover will snap into its locking position and (3) limit the inward travel of the cover so that it will remain seated in a position that will facilitate easy removal with a simple tool.

To strengthen the container at its base, the bottom wall 16 is preferably located just above a lower edge portion 42 of the sidewall 14. A concentric circular flange 44 of considerably smaller diameter is also provided on the lower surface of the bottom wall to give it added strength and stiffness. Spaced apart circumferentially and extending inwardly from the inner surface of container sidewall 14 are a series of longitudinally extending ribs 46. These ribs, as shown in FIG. 1, serve to limit the amount of nesting of stacked containers during shipment and storage, so that they can be easily separated when they are to be filled.

Near the top of the container 10 and disposed 180° apart on opposite sides thereof are a pair of ear-like projections 50 for anchoring the hooked ends 52 of a wire bail or handle 54. These anchoring projections are molded integral with the container body and each comprises an outer wall portion 56 that extends downwardly from the lower edge of the outer flange 24 and a pair of side walls 58 that connect the edges of the outer wall portion 56 with the side wall portions 14 and 18 of the container. A V-shaped slot 60 is provided in the lower edge of the outer wall which, at its narrowest point 62, connects with an open sided hole 64 for receiving the end of the wire bail 54. Other forms of bail holding structures could also be used within the scope of the invention.

The cover 12 for the container 10 according to the present invention is formed from sheet metal such as cold rolled steel having a thickness of 0.010 inches. Preferably the sheet metal is tin plated as with many conventional metal containers.

The cover has a recessed central wall section 66 surrounded by a peripheral inverted U-shaped channel 68 adjacent to an outer generally U-shaped open channel 70. The inverted channel 68 is formed by an annular bead portion 72 from the outer edge of which extends a cylindrical flange 74. At the lower end of this flange the metal radially curves outwardly and around and then a lower outer conical flange portion 76 extends back toward the flange 74 at an angle of roughly 30°. The lower outer flange 76 terminates at an annular bend 78 that is uniformly distant from the flange 74 around it. From the annular bend 78 an upper outer flange portion 80 extends outwardly and upwardly at a uniform angle (e.g. 20°) to the central axis of the cover. At the upper outer end of this latter flange portion is a fully closed curl forming a peripheral bead 82 around the cover.

As seen in FIG. 5, the relative size and shape of the integral portions of the cover allows the outer flange portions 76 and 80 to flex and move about the bend line 78 and also relative to the inner cylindrical flange 74. The lower portion of the flange 74 together with the lower outer flange portion 76 forms a resiliently distortable bulbous locking member 84 that cooperates with the annular beads 28 and 30 of the container to retain the cover firmly on the container.

Figure 6:
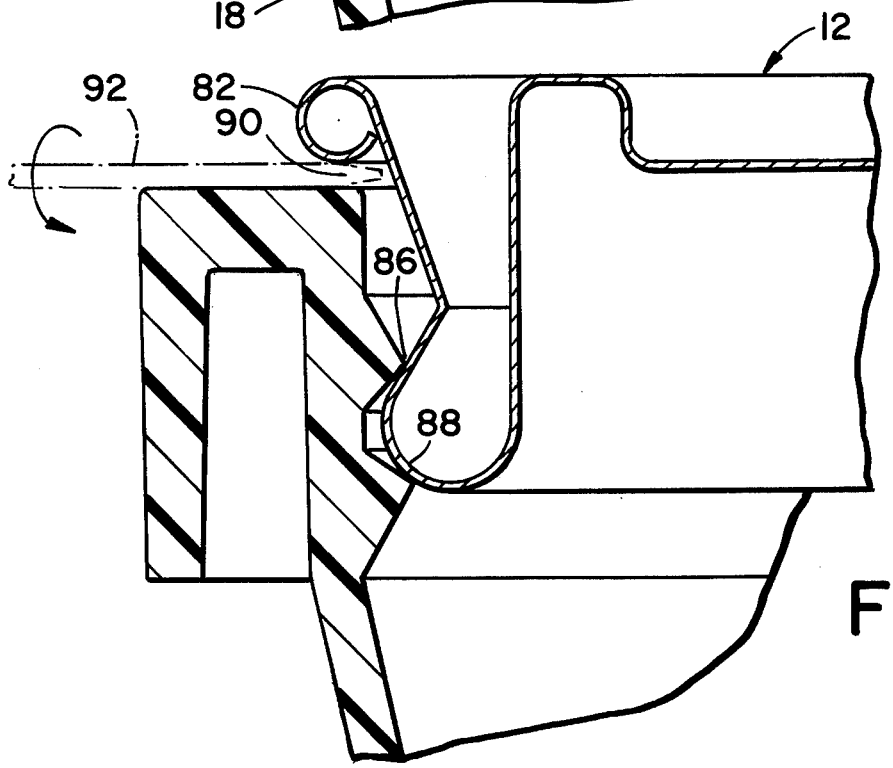
FIG. 6 is a fragmentary view in elevation and in section showing the container and cover of FIG. 6 in the fully assembled position.

The cooperative locking action between the cover 12 and the container 10 may be most easily understood by reference to FIGS. 5 and 6. When the cover 12 is installed, it is positioned above an open container 10 and then moved downwardly until the annular bulbous locking member 84 engages the upper conical surface 34 of the container bead 28. As this contact is made and downward force is exerted against the cover, the upper end portion of the container stretches circumferentially a small amount. Also, the lower outer flange portion 76 of the cover is deflected inwardly toward the cylindrical flange 74 a slight amount and this flexing is helped to occur because of the annular bend line 78. When the bulbous cover portion 84 moves downwardly past the upper container bead 28, it returns to its original shape as it snaps into the annular recess between the beads 28 and 30, and the upper end of the container grips the cover like a heavy elastomeric band. The lower bead 30 serves as a stop member that limits the downward travel of the cover and its penetration into the container. When the bulbous locking member 84 is properly seated within the recess, as shown in FIG. 6, the upper bead 28 bears against the cover to form a fluid tight seal at the point indicated by numeral 86. A second similar fluid tight seal is formed by the lower bead 30 along the annular contact point indicated by the numeral 88.

In addition to the aforesaid sealing functions of the two beads 28 and 30, the lower bead serves to position the cover so that a narrow annular space 90 is formed between the peripheral bead 82 and the flat end flange 22 on the top edge of the container. This provides easy access for a simple tool such as a screwdriver 92 which can be inserted, as shown in phantom in FIG. 6, and then twisted to remove the cover from the paint filled container 10.

Thus, from the foregoing, it should be apparent that the present invention provides a highly efficient and economical container and cover package, particularly for liquid products such as paint and the like that require air-tight sealing. When installed on a container 10, the cover 12 provides such sealing with the two annular sealing contacts. Yet, the cover can easily by "popped" off and then replaced so that the contents of the container can be preserved for reuse. In addition, both cover and container may be readily manufactured at high production rates and relatively low unit cost as compared with conventional containers for similar products heretofore used.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A container made of plastic material in combination with a closure made of metal, said container comprising a body with a continuous sidewall, an integral bottom section and an open top, for receiving said closure, a first and upper ridge member and a second or lower ridge member spaced below on the inside surface of said sidewall near said open top, said ridge members being integral with and extending inwardly from the inside surface of said container sidewall for forming an annular recess that provides a fluid tight seal with said closure.

2. The container as described in claim 1 wherein both said ridge members have generally triangular cross sections and said closure has a generally U-shaped outer channel section around its periphery which fits between and forms sealing contacts with said ridge members when said closure is installed on said container.

3. The container as described in claim 2 wherein both said ridge members have upper conical surfaces, said upper ridge member having a conical surface that functions to cam said U-shaped channel section of said closure inwardly as it is installed on said container.

4. The container as described in claim 3 wherein said upper conical surface on said upper ridge member forms an acute angle with the inner surface of said container sidewall that is less than the acute angle formed by the upper conical surface of said lower ridge member with the sidewall surface.

5. The container as described in claim 2 wherein said lower ridge member has a smaller inner diameter than said upper ridge member and serves as a positioning stop member for said closure.

6. The container as described in claim 5 wherein said U-shaped channel section of said closure has a generally cylindrical inner flange portion and an outer flange portion formed by integral upper and lower conical elements, said lower conical element being connected to said inner flange portion by a curved bottom portion and extending upwardly toward said upper conical element that extends upwardly and outwardly.

7. The container as described in claim 6 wherein said upper conical element of said U-shaped channel is terminated by a curled back element along its outer edge, said curled back element being spaced above the upper end of said container when said closure is installed thereon in contact with said lower ridge member.

8. In combination, plastic container and a semi-rigid metal closure therefor, said container comprising:

a conical sidewall;

an integral bottom member at the lower and smaller end of said sidewall;

an inverted U-shaped channel member integral with and extending peripherally around the lower and open, upper end of said sidewall;

and a pair of spaced apart ridge members, integral with and extending inwardly from near the upper open end of said sidewall, said ridge members forming an annular recess for receiving and sealing against said metal closure; and said closure comprising:

a center section surrounded by a generally U-shaped channel member having an inner flange connected to said center section, an outer flange, and a slightly enlarged interconnecting portion located at the lower edges of said inner and outer flanges and adapted to extend at least partially into said annular recess of said container when said closure is installed thereon.

9. The container and closure combination as described in claim 8 wherein said closure has a bead means around the outer edge periphery of said outer flange of said closure, one of said ridge members of said container being located so as to limit the amount of insertion of said closure within said container, thereby providing an annular space between said bead means and the upper edge of said container when said closure is installed thereon, to facilitate the insertion of a removal tool.

* * * * *